US005794556A

United States Patent [19]

Kobayashi

[11] Patent Number: 5,794,556

[45] Date of Patent: Aug. 18, 1998

[54] HULL FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 698,484

[22] Filed: Aug. 15, 1996

Related U.S. Application Data

[63] Continuation of Ser. No. 442,022, May 16, 1995, abandoned.

[30] Foreign Application Priority Data

May 16, 1994 [JP] Japan ..... 6-101074

[51] Int. Cl.[6] ..... B63B 43/14

[52] U.S. Cl. ..... 114/123; 114/270; 114/363

[58] Field of Search ..... 114/56, 123, 270, 114/271, 291, 362, 363, 290, 361

[56] References Cited

U.S. PATENT DOCUMENTS

| | | | |
|---|---|---|---|
| 2,919,669 | 1/1960 | Kikuhara . | |
| 3,106,178 | 10/1963 | Cale . | |
| 3,115,860 | 12/1963 | Payne . | |
| 3,438,073 | 4/1969 | Brown | 114/361 |
| 3,481,297 | 12/1969 | Mantle . | |
| 4,233,920 | 11/1980 | Wood et al. | 114/291 |
| 4,320,713 | 3/1982 | Nishida et al. | 114/123 |
| 4,458,622 | 7/1984 | Anderson . | |
| 4,726,317 | 2/1988 | Ritten et al. | 114/362 |
| 4,893,579 | 1/1990 | Kobayashi | 114/363 |
| 4,909,176 | 3/1990 | Kobayashi | 114/270 |
| 5,199,366 | 4/1993 | Ranchi | 114/56 |
| 5,205,235 | 4/1993 | Hodges | 114/290 |
| 5,218,922 | 6/1993 | Kobayashi | 114/363 |
| 5,313,907 | 5/1994 | Hodges . | |
| 5,447,459 | 9/1995 | Hammond | 441/135 |

FOREIGN PATENT DOCUMENTS

| | | | |
|---|---|---|---|
| 2574747 | 6/1986 | France . | |
| 357644 | 8/1922 | Germany . | |
| 85090 | 3/1990 | Japan | 114/270 |
| 404266589 | 9/1992 | Japan | 114/363 |
| 6-191466 | 7/1994 | Japan . | |

*Primary Examiner*—Sherman Basinger

*Attorney, Agent, or Firm*—Knobbe, Martens, Olson & Bear, LLP

[57] ABSTRACT

A small watercraft has a longitudinally extending seat for the operator of the watercraft and one or more passengers. Located on each side of the longitudinally extending seat is a side seat which is configured to seat an additional passenger. This configuration allows an operator and up to four passengers to ride in the watercraft. The watercraft also has a rear deck positioned to the rear of a passenger area which has a ladder and a pair of hand grips to facilitate embarking and disembarking of the watercraft. The hull of the watercraft has a V-bottom to improve stability and maneuverability. The V-bottom hull includes a pair of angularly disposed surfaces terminating at a pair of longitudinally extending chines. Inclined side surfaces extend generally upwardly from the chines and a sponson is located on each of the side surfaces, proximate the rear of the watercraft, to improve the stability, buoyancy and maneuverability of the watercraft.

28 Claims, 6 Drawing Sheets

HULL FOR SMALL WATERCRAFT

This application is a continuation of U.S. patent application Ser. No. 08/442,022, filed May 16, 1995 and now abandoned.

BACKGROUND OF THE INVENTION

The present invention relates in general to a watercraft and, in particular, to an improved hull arrangement for such a watercraft.

A wide variety of watercraft are available to the public. One type of watercraft which is extremely popular is a relatively small watercraft that is designed to be operated by a rider sitting in a seated straddle fashion and generally centrally positioned in the watercraft. Conventionally, this type of watercraft includes a powering internal combustion engine and a propulsion device, such as a jet propulsion unit, driven by the engine for propelling the watercraft. This type of watercraft is generally called a personal watercraft and is designed primarily to be utilized by a single rider or a rider and one passenger.

In order to provide greater versatility for these watercraft, arrangements have been provided where multiple passengers may be seated in addition to the rider. However, because of the very nature of a personal watercraft, it is desirable to maintain the hull and the passenger's compartment quite small and compact. Also, to obtain optimum performance, the hull should be relatively narrow and the watercraft should be quite maneuverable.

Because of the small size of this type of watercraft, if multiple passengers are to be accommodated, the seating position should be such that the balance of the watercraft, primarily side to side, can be maintained regardless of the number of passengers accommodated.

To achieve this end, it has been proposed to provide a watercraft with a longitudinally extending centrally positioned seat on which one, two, or possibly three riders may be seated in straddle, tandem fashion. In addition, there are provided at the rear of the watercraft a pair of side seats so that any number of passengers from one to five may be accommodated and side-by-side balance maintained regardless of the number of passengers.

Obviously, such variations in seating positions can give rise to quite different loadings of the watercraft in a fore and aft direction. In addition, it is the normal practice with this type of watercraft to enter it from the body of water in which the watercraft is operating. Frequently, a rear deck is provided for this purpose. In addition to these factors, frequently the engine and normally always the propulsion device is located at the rear of the watercraft and beneath the seat. Thus, there may be high rearweight bias which can dictate wide hull designs.

It has been proposed, therefore, to provide a hull configuration that is narrow at the front but wide at the rear so as to accommodate the situation when a pair of rear passengers or three rear passengers are accommodated or when the watercraft is being boarded from the rear.

The disadvantage with this type of construction is that the widened hull can give rise to drag and unnecessary water resistance when a lesser number of passengers are being accommodated.

It is, therefore, a principle object of this invention to provide an improved hull design for a small watercraft.

It is a further object of this invention to provide a hull design for a small watercraft that will provide buoyancy and control regardless of the number of passengers accommodated but which will not provide large drags when a small number of passengers are accommodated.

SUMMARY OF THE INVENTION

This invention is adapted to be embodied in a hull for a small watercraft having a passenger's area disposed to the rear of it. The hull is designed so that a pair of sponsons are positioned at the rear of the hull on the sides of the passenger's area in a location to be out of the water when the watercraft is traveling straight ahead and there is not a large rearward weight bias of the passengers. However, these sponsons can contact the water when the watercraft is loaded more to the rear or when the watercraft tends to lean to a large extent to offer stability and buoyancy under these conditions.

BRIEF DESCRIPTION OF THE DRAWINGS

These and other features of the invention will now be described with reference to the drawings of a preferred embodiment, which are intended to illustrate and not to limit the invention, in which.

DETAILED DESCRIPTION OF THE PREFERRED EMBODIMENTS

Figure 1:
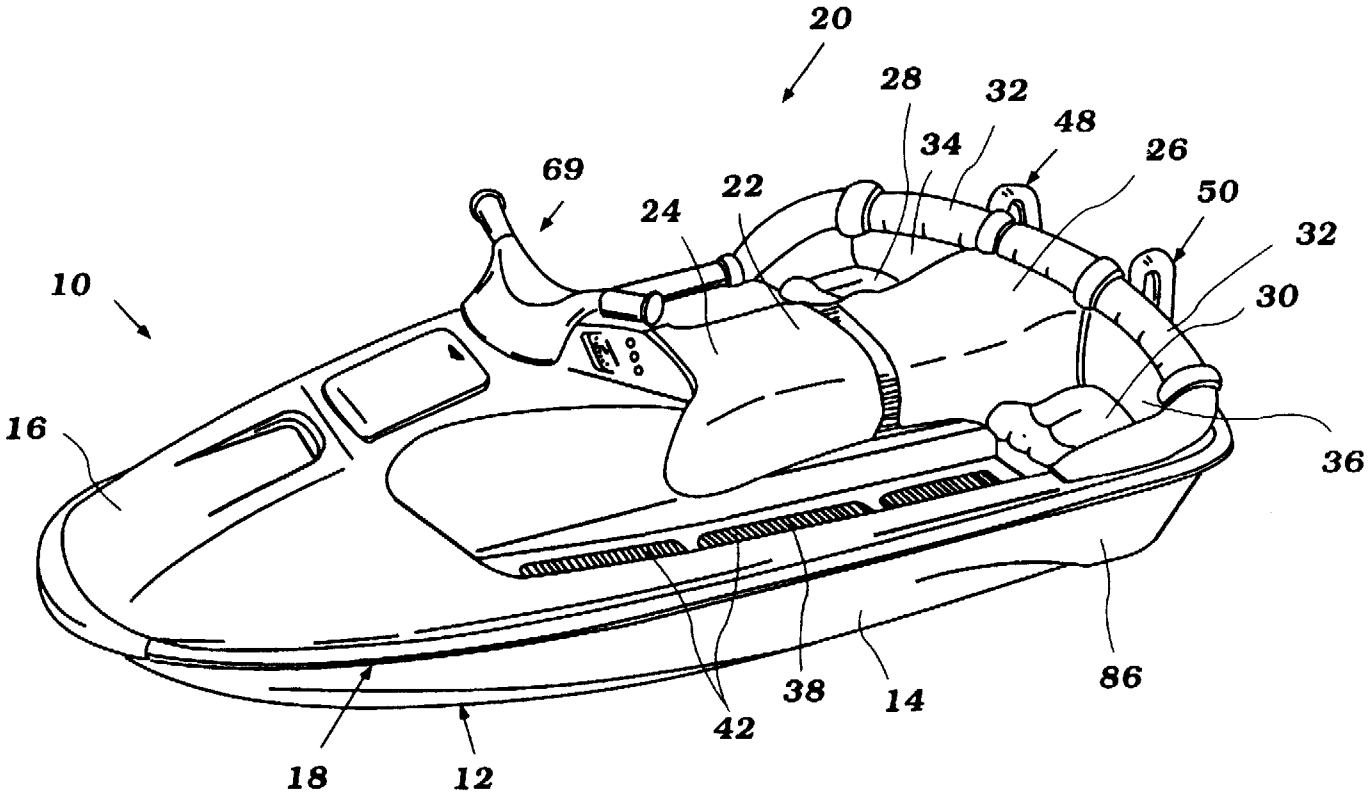
FIG. 1 is a side elevational view of a small watercraft constructed in accordance with the preferred embodiment of the present invention.
Figure 2:
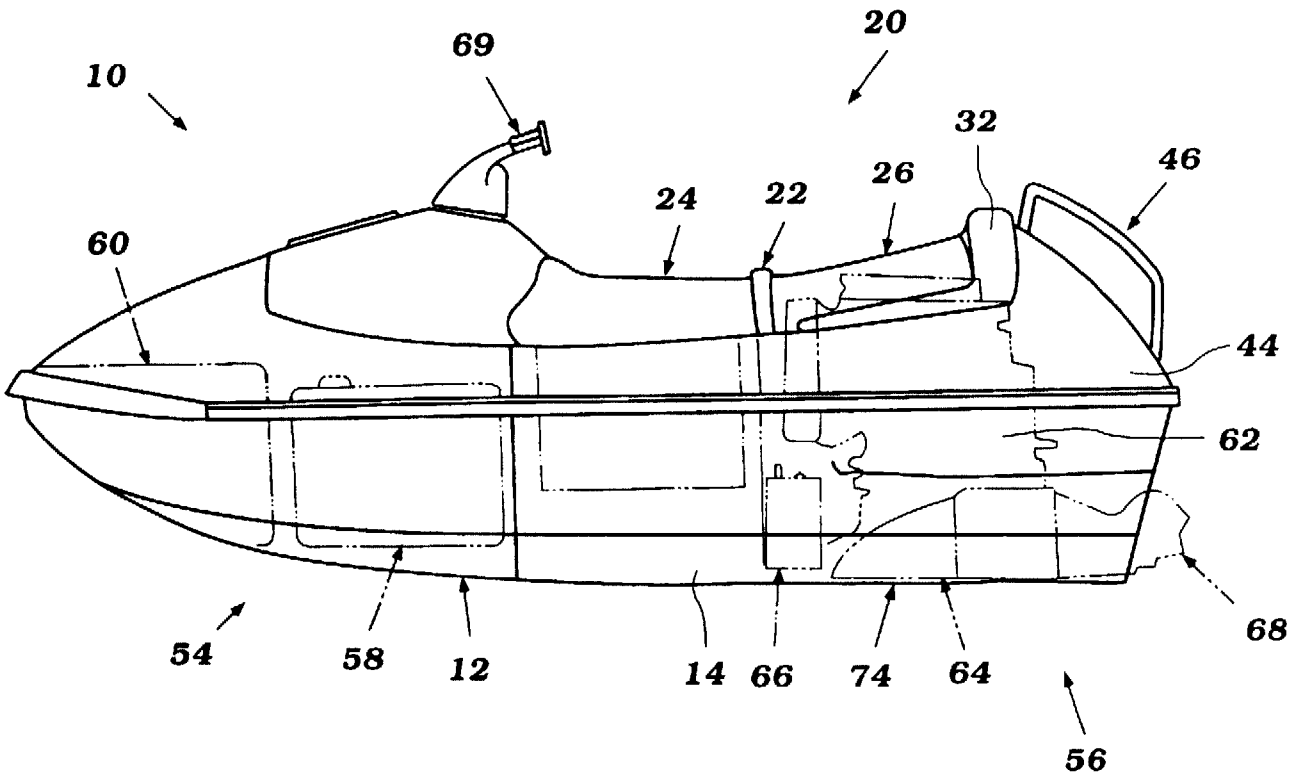
FIG. 2 is a side view of the watercraft of FIG. 1 with the internal components shown in phantom.

Referring now in detail to the drawings and initially to FIGS. 1 and 2, a relatively small personal watercraft constructed in accordance with an embodiment of the invention is identified generally by the reference numeral 10. The watercraft 10 is comprised of a hull, indicated generally by the reference numeral 12, and comprised of a lower hull portion 14 and an upper deck portion 16. The hull portions 14 and 16 are formed from a suitable material, such as a molded fiberglass reinforced resin. The lower hull portion 14 and the upper deck portion 16 are affixed to each other around their peripheral edges 18 in any suitable manner.

A passenger compartment, indicated generally by the reference numeral 20, is provided proximate the rear of the hull 12. The passenger compartment 20 includes an elongated seat 22 that is generally mounted longitudinally within the watercraft 10. The elongated seat 22 is generally centrally located within the passenger compartment 20 and includes an operator seat portion 24 and a passenger portion 26. The operator seat portion 24 is centrally positioned to allow the operator easy access to the controls of the watercraft 10 and fore and aft balance when the operator is alone. The passenger portion 26 is configured to allow one or two passengers to be comfortably seated behind the operator of the watercraft. The elongated seat 22 may consist of a longitudinally extended straddle-type seat which may be straddled by the operator and passengers. Additionally, the elongated seat 22 may be padded and contoured for increased comfort of the operator and passengers.

Figure 3:
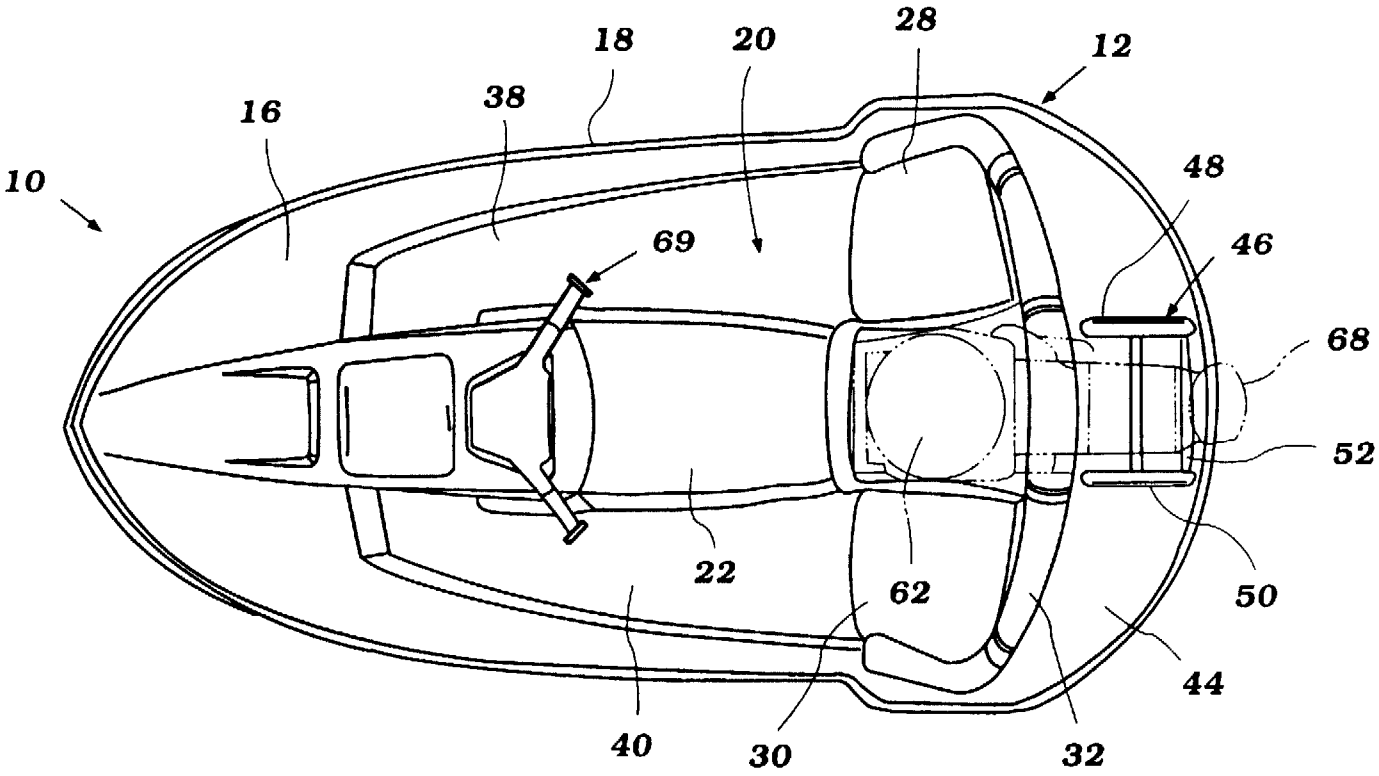
FIG. 3 is a top plan view of the watercraft of FIG. 1.
Figure 4:
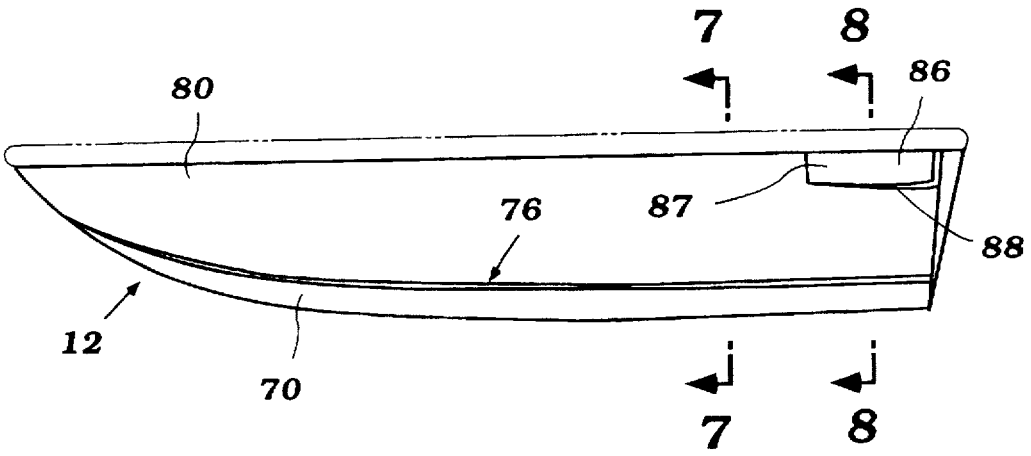
FIG. 4 is a partial side view showing the hull of the watercraft of FIG. 1.

Adjacent the elongated seat 22 are a pair of side passenger seats 28 and 30. As best seen in FIGS. 1 and 3, the side passenger seats 28 and 30 are transversely located on each side of the elongated seat 22, proximate the rear of the watercraft 10. These side passenger seats 28 and 30 are configured to allow a passenger to ride in the watercraft 10 along side the elongated seat 22. This allows the watercraft 10 to have up to five persons riding in the watercraft 10. Advantageously, because the side passenger seats 28 and 30 are located on each side of the elongates seat 22, this allows the weight of the passengers to be more evenly distributed within the watercraft 10, and this increases the stability of the watercraft 10.

Thus, the seating arrangements provided by the seat 22 and side seats 28 and 30 permits one, two, three, four, or five riders to be accommodated without disrupting the side to-side balance of the watercraft. When only the operator is present he may sit on the seat portion 24 toward the rear thereof so as to maintain good balance. If a first passenger is added, the operator shifts forwardly on the seat portion 24 and the one rider sits behind him again to maintain both fore and aft and side-to-side balance.

If a second passenger (three occupants) is added, either the two riders may sit in the side seats 28 and 30 or the riders may all sit in tandem fashion on the seat 22. In either event, side-to-side balance is maintained. The front-to-rear balance will be somewhat upset when the two passengers sit on the rear seats but if the operator moves forwardly on the seat portion 24, then the front-to-rear balance will still be fairly stable.

If four occupants are present, two sit on the seat 22 and one each on the seats 28 and 30. Again, balance will be maintained. The fifth rider can be accommodated seated behind the other rider on the seat 22 so that there will be three occupants on the seat 22 and one each in the seats 28 and 30. Thus, balance is maintained under all conditions.

As seen in FIG. 1, the side passenger seats 28 and 30 are located generally lower in the watercraft 10 than the elongated seat 22. This allows the surrounding upper deck portion of the hull 16, indicated generally by the reference numeral 32, to create seat backs 34 and 36 for the respective side passenger seats 28 and 30. In addition, the rear portion 32 extends slightly along the outer sides of the hull 12 to provide lateral support for the side passenger seats 28 and 30. Preferably, the rear portion 32 is covered with a padded material for increased comfort of the riders.

As seen in FIGS. 1 and 3, foot areas 38 and 40 are also provided for the operator and passengers of the watercraft 10. The foot areas 38 and 40 extend generally longitudinally and parallel to the sides of the elongated seat 22 so that the operator and any passengers sitting on the elongated seat 22 may place their feet in the foot areas 38 and 40. The foot areas 38 and 40 are also located forward of the side passenger seats 28 and 30 so that passengers may sit on the side seats 28 and 30 with their feet in the foot areas 38 and 40, respectively, in a normally seated fashion. Preferably, a non-slip surface 42 as shown in FIG. 1 is located in the foot areas 38 and 40 to provide increased grip and traction for the operator and passengers.

As best seen in FIGS. 2 and 3, proximate the rear of the watercraft 10 is a rear deck 44. The rear deck 44 is located behind the passenger compartment 20 and includes a ladder 46 which is configured to facilitate the boarding and entry of the watercraft 10. The ladder 46 may be particularly useful when boarding the watercraft 10 from the water. The ladder 46 includes a pair of handles 48 and 50 which generally extend upwardly and one or more steps 52 may be located between the handles 48 and 50 to further aid persons in boarding the watercraft 10.

The general layout of the major components of the watercraft 10 is best seen in FIG. 2. The lower hull portion 14 of the watercraft 10 is generally divided into a forward compartment 54 and a rear compartment 56. Located in the forward compartment 54 is a fuel tank 58 and a buoyant block 60 to afford further buoyancy to the watercraft 10. Located in the rear compartment 56 and beneath the rear portion of the seat 22 is an internal combustion engine 62 which is used to power the watercraft 10. It will be understood that the engine 62 may be of any known type and more than one engine may be used to power the watercraft 10. Preferably the engine is arranged so that its output shaft rotates about a vertical axis. A battery 66 may be positioned proximate the engine 62 to provide a source of electrical power for accessories for the watercraft 10 and for starting the engine 62.

The engine 62 is used to power a jet propulsion unit 64 to propel the watercraft 10. The jet propulsion unit 64 is positioned in a tunnel in the rear center of the hull portion 12 and has a downwardly facing water inlet portion 74 through which water is drawn from the body of water in which the watercraft 10 is operated by an impeller. The impeller is driven by the output shaft of the engine 62. If the engine output shaft is vertically disposed, as noted before as a preferred configuration, then the impeller will be driven through a bevel gear transmission or similar transmission. The water driven by the impeller is discharged through a steering nozzle 68 which is pivotally supported at the rear of the jet propulsion unit 64 for powering the watercraft 10 and also for steering the watercraft 10.

The steering nozzle 68 is connected to a steering handle bar assembly 69 which is mounted in front of the operator's seat 24. The steering nozzle 68 may be steered in a well known manner and it should also be understood that the steering handle bar assembly 69 may incorporate a throttle control for controlling the speed of the engine 62. As seen in FIG. 3, a portion of the elongated seat 22 may be removed to provide access to the engine 62.

Figure 5:
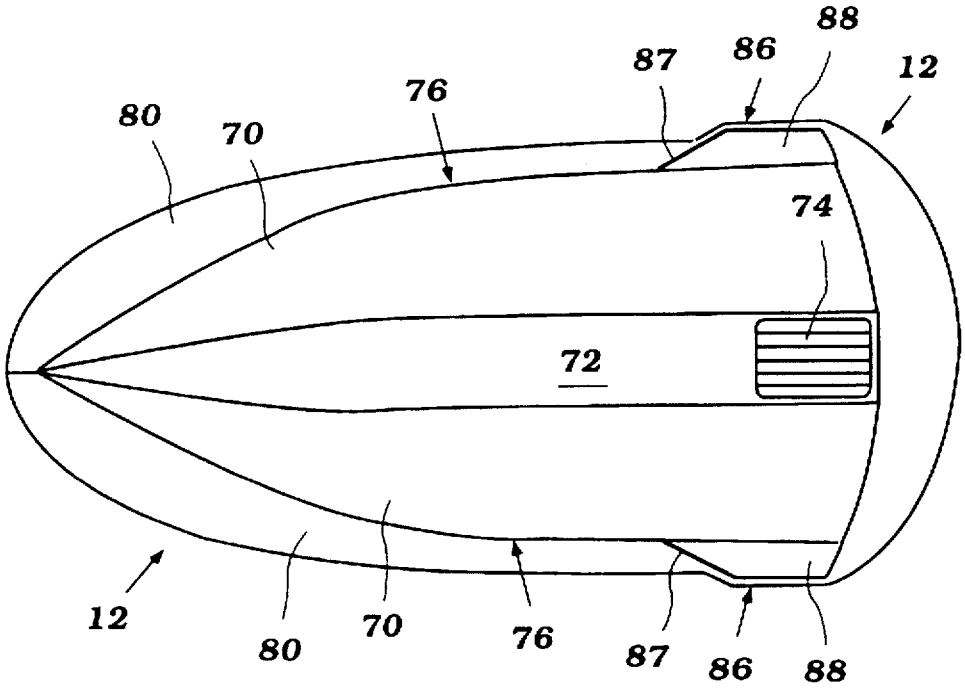
FIG. 5 is a bottom view of the watercraft of FIG. 1.
Figure 6:
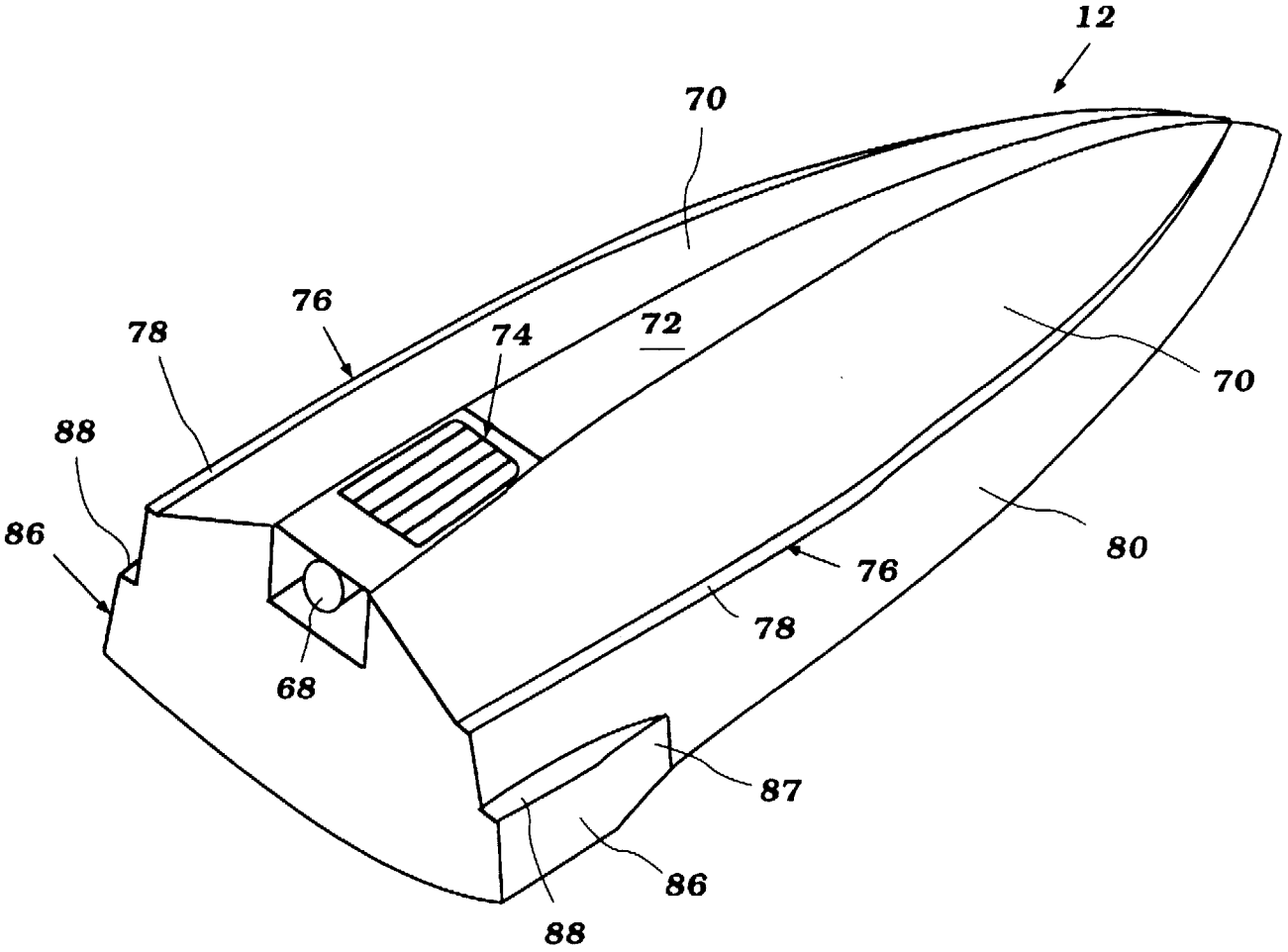
FIG. 6 is a bottom elevational view of the watercraft of FIG. 1.
Figure 7:
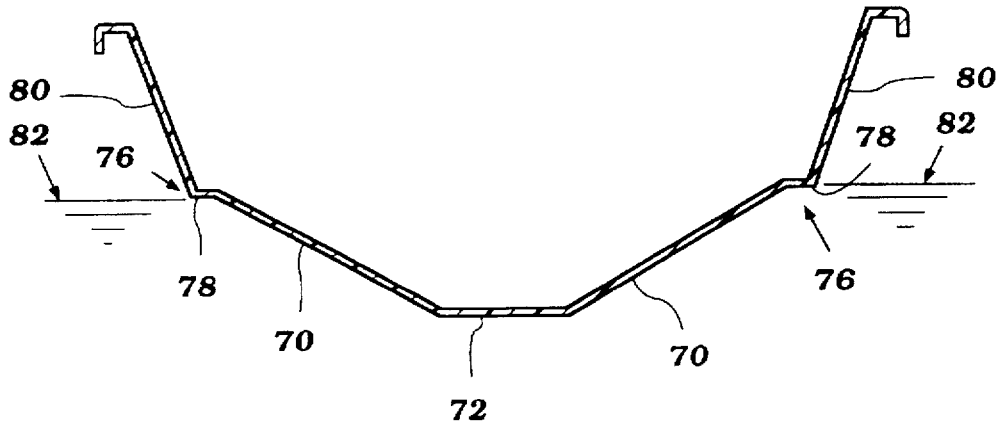
FIG. 7 is a partial cross sectional view along lines 7—7 of FIG. 4.

As may be best seen in FIGS. 5 and 6, the underside of the hull 12 has a generally V-bottom comprised of a pair of angularly disposed portions 70 which extend outwardly from a generally flat center section 72 of the hull 12. The center section 72 includes the water inlet portion 74 for the jet propulsion unit located proximate the rear of the watercraft 10 and close to the aforenoted tunnel in which the jet propulsion unit 64 is positioned. The angularly disposed portions 70 terminate at longitudinally extending chines or steps 76. As best seen in FIG. 7, the chines 76 have a generally flat surface 78 that is generally parallel to the center section 72 of the hull 12. The water level 82 in which the watercraft 10 is operating is preferably generally aligned with the chines 76 when the watercraft is not fully loaded and is traveling straight ahead. This arrangement permits a fairly narrow hull which accommodates very quick and sharp maneuverability.

Figure 8:
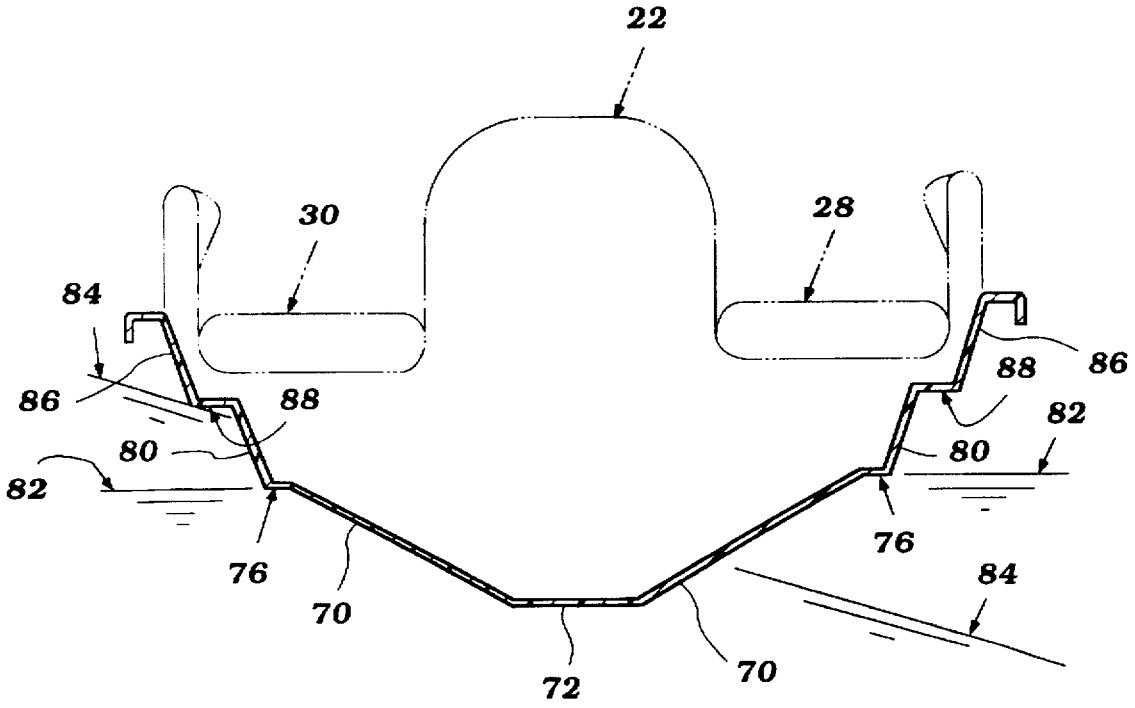
FIG. 8 is a partial cross sectional view along lines 8—8 of FIG. 4.

Outwardly of the chines 76, the hull 12 is provided with a pair of further inclined side surfaces 80 which are inclined more steeply than the angularly disposed surfaces 70. As best seen in FIG. 8, the side surfaces 80 are normally out of the water when traveling straight ahead and at planing speeds and hence will reduce drag and improve speed and maneuverability. However, when the watercraft 10 turns, the hull 12 leans or keels over and the surfaces 80 will become engaged in the body of water by the water line 84. This increases the maneuverability and affords stability as a watercraft 10 tends to lean over during turns.

A sponson 86 is located above the chime 76 on both sides of the hull 12 of the watercraft 10. As best seen in FIGS. 5 and 7, the sponsons 86 are positioned near the upper surface of the lower hull portion 14, proximate the rear of the watercraft 10. The sponsons 86 extend outwardly for increased buoyancy and the sponsons increase the stability of the watercraft 10. In further detail, the sponsons 86 protrude from the upper surface of the lower hull 14 generally proximate the side passenger seats 28 and 30. The sponsons 86 have a generally tapered forward surface 87 and a generally flat lower surface 88. As best seen in FIG. 8, the flat lower surface 88 creates an additional chime which is normally out of the water when the watercraft 10 is traveling in a straight line and when planing. However, when the watercraft 10 turns, the sponson 86 may contact the water 84 and this increases the stability of the watercraft 10 and is useful in preventing the watercraft 10 from capsizing.

The sponsons 86 are particularly useful when the watercraft 10 is carrying numerous passengers because the passengers increase the weight of the watercraft 10. In this loaded condition, the watercraft 10 may tend to lean more during sharp maneuvers, but the sponsons 86 provide increased stability because the additional chines and increased buoyancy of the sponsons 86 help compensate and support the additional weight in the watercraft 10.

The sponsons 86 also provide added buoyancy when the watercraft is not loaded and when one or more individuals are attempting to enter the watercraft 10 through the use of the boarding ladder 46 to enter onto the rear deck 44.

As best seen in FIG. 8, the inner sides surfaces of each side wall of the hull 12 includes a flared section. The flared section flares in a direction of the corresponding outer side surface of the hull side wall along at least a portion of the length of the corresponding sponson 86. These flared sections widen at least a portion of the passenger area between the sponsons 86.

It should be readily apparent from the foregoing description that the described embodiment of the invention is very effective in fulfilling the desired aspects of the invention. Although this invention has been described in terms of certain preferred embodiments, other embodiments apparent to those of ordinary skill in the art are also within the scope of this invention. Accordingly, the scope of the invention is intended to be defined only by the claims which follow.

I claim:

1. A small watercraft comprising a hull having an undersurface and side walls, each side wall including a side surface, at least one passenger area formed at least in part between the side walls of said hull and located in front of a transom of the hull the passenger area including a center seat extending along a longitudinal axis of the hull, a steering assembly located in front of the passenger area and generally at a midpoint between said side walls, and a pair of sponsons each located on a respective one of said side surfaces of said side walls and being integrally formed with the respective side surface with a body of said sponson forming part of the respective side wall of the hull, each sponson extending forwardly from said transom only for a portion of a length of the passenger area and terminating behind the steering assembly, a lower surface of each sponson being disposed so that the lower surface is normally above the level of water in which the watercraft is operating except under unique loading conditions, such loading conditions including generally when the watercraft is turning, when a load larger than that created by an average-sized rider, who properly seated on the watercraft, is applied to the passenger area of the watercraft, and when at least one average-sized rider enters the watercraft from a rear end.

2. A small watercraft as set forth in claim 1, wherein the hull undersurface has a generally V-bottom positioned between a pair of chines disposed at the outer peripheral edges of the undersurface where the V-bottom joins the side surfaces, said chines being normally positioned above the water level when the watercraft is planing.

3. A small watercraft as set forth in claim 2 wherein said lower surface of each sponson is flat and together with an outer side of the sponson forms another chine on an outer side of said watercraft.

4. A small watercraft as set forth in claim 1 further comprising a rear deck positioned to the rear of said passenger area.

5. A small watercraft as set forth in claim 4 further comprising a ladder on said rear deck having a pair of handles to facilitate embarking and disembarking said watercraft.

6. A small watercraft as set forth in claim 5, wherein the hull undersurface has a generally V-bottom positioned between a pair of chines disposed at the outer peripheral edges of the undersurface where the V-bottom joins the side surfaces, said chines being normally positioned above the water level when the watercraft is planing.

7. A small watercraft as set forth in claim 1, wherein the passenger area is provided with a pair of side seats formed adjacent said transom and disposed on opposite sides of said center seat.

8. A small watercraft as set forth in claim 7, wherein the sponsons are positioned proximate the side seats.

9. A small watercraft as set forth in claim 8 wherein said lower surfaces of each sponson is flat and together with an outer side of the sponson forms another chine on an outer side of said watercraft.

10. A small watercraft comprising a hull having an undersurface and side walls, each side wall including a side surface, a passenger area formed at least in part between the side walls of the hull and located in front of a transom of the hull, the passenger area including a center seat extending along a longitudinal axis of the hull and a pair of side seats positioned within the passenger area at the rear of said watercraft and formed adjacent said transom, and a pair of sponsons each located on a respective one of said side surfaces of said side walls and being integrally formed with the respective side surface with a body of said sponson forming part of the respective side wall, each sponson extending forwardly from said transom and terminating at a point to the side of the passenger area, a lower surface of each sponson being disposed so that the lower surface is normally above the level of water in which the watercraft is operating except under unique loading conditions, such loading conditions including generally when the watercraft is turning, when a load larger than that created by an average-sized rider, who is properly seated on the watercraft, is applied to the passenger area of the watercraft, or when at least one average-sized rider enters the watercraft from a rear end.

11. A small watercraft as set forth in claim 10, wherein the sponsons are positioned proximate the side seats.

12. A small watercraft as set forth in claim 10, wherein the hull undersurface has a generally V-bottom positioned between a pair of chines disposed at the outer peripheral edges of the undersurface where the V-bottom joins the side surfaces, said chines being normally positioned above the water level when the watercraft is planing.

13. A small watercraft as set forth in claim 12 wherein said lower surface of each sponson is flat and, together with an outer side of the sponson, forms another chine on an outer of said watercraft.

14. A small watercraft as set forth in claim 10 further comprising a rear deck positioned to the rear of said passenger area.

15. A small watercraft as set forth in claim 14 further comprising a ladder on said rear deck having a pair of handles to facilitate embarking and disembarking said watercraft.

16. A small watercraft comprising a hull having an undersurface and side walls, each side wall including a side surface, a passenger area formed at least in part between the side walls of the hull and located in front of a transom of the hull, the passenger area being provided with a longitudinally extending center seat on which a rider and at least one passenger may be seated in straddle tandem fashion and a pair of side seats formed adjacent said transom and disposed on opposite sides of said center seat, and a pair of sponsons each located on a respective one of said side surfaces of said side walls and being integrally formed with the respective side surface with a body of said sponson forming part of the respective side wall of the hull, each sponson extending forwardly from said transom and terminating adjacent the sides of said passenger's area, a lower surface of each sponson being disposed so that the lower surface is normally above the level of water in which the watercraft is operating except when the watercraft is turning and/or when a load larger than that created by the rider is applied to the passenger area of the watercraft.

17. A small watercraft as set forth in claim 16, wherein the sponsons are positioned proximate the side seats.

18. A small watercraft as set forth in claim 16, wherein the hull undersurface has a generally V-bottom positioned between a pair of chines disposed at the outer peripheral edges of the undersurface where the V-bottom joins the side surfaces, said chines being normally positioned above the water level when the watercraft is planing.

19. A small watercraft as set forth in claim 16 wherein said lower surface of each sponson is flat and, together with an outer side of the sponson, forms another chine on an outer side of said watercraft.

20. A small watercraft as set forth in claim 19 additionally comprising a rear deck positioned to the rear of said passenger area and a ladder on said rear deck having a pair of handles to facilitate embarking and disembarking said watercraft.

21. A small watercraft comprising a hull having an undersurface and side walls, each side wall including an inner side surface and an outer side surface, a passenger area formed at least in part between the inner side surfaces of the side walls of said hull and located in front of a transom of the hull, and a pair of sponsons each located on a respective one of said outer side surfaces of said side walls and being integrally formed with the respective outer side surface with a body of said sponson forming part of the respective side wall of the hull, the inner side surface of each side wall including a flared section which flares in a direction of the corresponding outer side surface along at least a portion of the length of the corresponding sponson so as to widen at least a portion of the passenger area between the sponsons.

22. A small watercraft as in claim 21, wherein a lower surface of each sponson is disposed so that the lower surface normally lies above the level of water in which the watercraft is operating except when the watercraft is turning and when a load larger than that created by an average-sized adult rider is applied to the passenger area of the watercraft.

23. A small watercraft as in claim 21, wherein the passenger area includes at least a pair of seats positioned between the flared sections of the side walls.

24. A small watercraft as in claim 23, wherein the passenger area additionally comprises an elongated seat that extends along a longitudinal center line of the hull.

25. A small watercraft as in claim 21 additionally comprising a rear deck positioned to the rear side of the passenger area.

26. A small watercraft as in claim 21, wherein the hull undersurface has a generally V-shaped surface defined between a pair of outer chines, the chines being positioned on the hull to normally lie above the water level when the watercraft is planing.

27. A small watercraft as in claim 26, wherein a lower surface of each sponson lies at a position on the hull above the corresponding outer chine.

28. A small watercraft as in claim 21, wherein each sponson includes a generally flat lower surface and a side surface, said lower surface and said side surface of said sponson together defining an upper chine on the corresponding side wall of the hull.

* * * * *

UNITED STATES PATENT AND TRADEMARK OFFICE

CERTIFICATE OF CORRECTION

PATENT NO. : 5,794,556

DATED : August 18, 1998

INVENTOR(S) : Noboru Kobayashi

It is certified that error appears in the above-identified patent and that said Letters Patent is hereby corrected as shown below:

In Claim 13, Col. 7, Line 10, "outer of said" should be --outer side of said--.

Signed and Sealed this

Fourth Day of May, 1999

*Attest:*

*Attesting Officer*

Q. TODD DICKINSON

*Acting Commissioner of Patents and Trademarks*